US005314244A

United States Patent [19]

Swets et al.

[11] Patent Number: 5,314,244

[45] Date of Patent: May 24, 1994

[54] PHARMACEUTICAL CABINET LOCKING ARRANGEMENT

[75] Inventors: Mark D. Swets, Grand Rapids; George A. Williams, Hudsonville; Steven F. Goodman, Wyoming, all of Mich.

[73] Assignee: Herman Miller, Inc., Zeeland, Mich.

[21] Appl. No.: 974,940

[22] Filed: Nov. 12, 1992

Related U.S. Application Data

[60] Division of Ser. No. 950,976, Sep. 23, 1992, Pat. No. 5,205,628, which is a continuation of Ser. No. 766,623, Sep. 26, 1991, abandoned, which is a continuation-in-part of Ser. No. 521,640, May 10, 1990, Pat. No. 5,069,511.

[51] Int. Cl.[5] ..... A47B 8/00

[52] U.S. Cl. ..... 312/330.1; 211/181; 312/216

[58] Field of Search ..... 312/330.1, 216, 265.1, 312/257.1, 301, 308, 309; 211/181

[56] References Cited

U.S. PATENT DOCUMENTS 3,167,183 1/1965 Claywell et al. ..... 211/181

*Primary Examiner*—Kenneth J. Dorner
*Assistant Examiner*—Gerald Anderson
*Attorney, Agent, or Firm*—Varnum, Riddering, Schmidt & Howlett

[57] ABSTRACT

A pharmaceutical cart for retaining a plurality of dispensing bins on shelves is provided with cooperating horizontal and vertical locking bars to provide easy access to each of the individual bins and a simplified locking mechanism which prevents bins from being removed when in a locked position. The cart is equipped with a plurality of cassettes, each having a pair of spaced-apart parallel shelves, and a plurality of dispensing bins disposed side-by-side on the shelves and slidably removable from the front of the cart. The horizontally extending locking bar, which has an elongated cross section, extends frontally to the lower part of bins on the upper shelf and the upper part of bins on the lower shelf. The locking bar is pivotally attached to the walls of the cassette and may be rotated to a horizontal position for removal of individual ones of the bins. The vertical locking bar is hingedly attached to one side of the cart and in its locking position extends in front of the cassettes to prevent their removal and engages the horizontal locking bar of each of the cassettes to prevent their rotation. In this manner, operation of the vertical locking bar to its locked position locks each of the cassettes and each of the bins individually.

15 Claims, 9 Drawing Sheets

PHARMACEUTICAL CABINET LOCKING ARRANGEMENT

This is a division, of application Ser. No. 07/950,976, filed Sep. 23, 1992, now U.S. Pat. No. 5,205,628, which is a continuation of application Ser. No. 07/766,623, filed Sep. 26, 1991, now abandoned, which is a continuation in part of 07/521,640, filed May 10, 1990, now U.S. Pat. No. 5,069,511, issued Dec. 3, 1991.

BACKGROUND OF THE INVENTION

1. Field of the Invention

The invention relates to pharmaceutical cabinets and particularly to lockable pharmaceutical cabinets comprising a plurality of medication bins.

2. Prior Art

Lockable pharmaceutical cabinets and carts are widely used in hospitals and other medical care facilities. Keeping pharmaceutical products secure from unauthorized access is a matter of major concern in the medical care facilities, not only to protect against theft and misuse of the pharmaceuticals but also to comply with legal requirements concerning controlled substances. Security of pharmaceutical carts used for delivering and dispensing pharmaceutical substances are of particular concern since the carts are of necessity used in areas where they are within easy reach of patients and other non-medical personnel. It is a general requirement in hospitals and the like that pharmaceutical carts be locked when not attended by an authorized person. It is therefore desirable to provide a cabinet or cart which may be readily locked and unlocked and which provides convenient storage and access for preselected pharmaceuticals to be dispensed. Pharmaceuticals to be dispensed may be contained within individual dispensing bins to be removed from the pharmaceutical cart or cabinet, one at a time. It is therefore desirable to provide an arrangement in which an individual dispensing bin may be conveniently removed and the remaining bins may be made secure in a convenient manner.

The U.S. Pat. No. 4,616,890 to J. M. Romick (issued Oct. 14, 1986) discloses a medication cart including cassettes of medication bins. Each cassette includes a plurality of stacked drawers slidably contained within a cabinet frame and a plurality of medication bins contained within each of the drawers. The several drawers of a cassette may be locked by means of a single locking bar internal to the cabinet frame and extending vertically along one side thereof. The locking bar engages each drawer individually and is operable in the vertical direction by means of a key lock.

The U.S. Pat. No. 3,893,740 to W. G. England (issued Jul. 8, 1975) discloses a multiple drawer cabinet having a lockable vertically extending locking bar external to the cabinet and pivotally attached to one edge thereof. The locking bar, in its locked position, extends along the front of several drawers to obstruct opening movement. The U.S. Pat. No. 3,902,603 to J. D. Wilson (issued Sep. 2, 1975) discloses a similarly positioned drawer retaining bar.

A disadvantage of the arrangement disclosed in the Romick patent is that the bins for containing the substances to be dispensed are contained within drawers. When such a cart is used for dispensing pharmaceuticals, a drawer containing several bins has to be at least partially withdrawn from the cabinet frame to gain access to any one of the bins. Closing the drawer each time after removal of a bin is inconvenient, but an open drawer detracts from a secure environment. The prior art arrangement does not provide for a secure and convenient access to individual bins and makes no provision for retaining or locking individually removable bins, not contained within a drawer. Similar disadvantages obtain with respect to other known prior art arrangements.

A further disadvantage of prior art pharmaceutical dispensing arrangements using removable cassettes for retaining a plurality of medicine dispensing bins is that the handling of the cassettes is made difficult by the weight of the cassette and a structure providing a lightweight cassette for medicine bins is desirable.

SUMMARY OF THE INVENTION

These and other problems of the prior art are overcome in accordance with this invention in a pharmaceutical cabinet having a support shelf and a plurality of slidably removable dispensing bins supported on the shelf in a side-by-side relation, by providing cooperating bin and cabinet locking bars extending substantially in mutually perpendicular directions. The bin locking bar, which has an elongated cross section is disposed frontally to the bins and is rotatable to a releasing position wherein the longer dimension of the elongated cross section extends parallel to the direction in which the bins are slidably removable from the shelf and rotatable to a locking position wherein the longer dimension extends in a direction perpendicular to the direction of sliding of the bins for restraining removal thereof. The cabinet locking bar is operable to one position for engagement with the bin locking bar to prevent its rotation and to maintain the bin locking bar in the locking position and to another position for disengagement from the bin locking bar to permit its rotation to the releasing position.

In one embodiment of the invention, the pharmaceutical cabinet comprises a plurality of support shelves and a plurality of bin locking bars disposed frontally to bins on the shelves and the cabinet locking bar is selectively movable to one position for engagement with the bin locking bars to prevent their rotation and to another position for disengagement from the bin locking bars to permit their rotation to the releasing position. Advantageously, in accordance with this invention, a cabinet locking bar cooperates with a plurality of bin locking bars to selectively allow and prevent removal of dispensing bins from a plurality of shelves of a pharmaceutical cabinet.

In a particular embodiment of the invention, a removable cassette for use in a pharmaceutical cabinet comprises lightweight structural bars interconnected to define a shelving structure for supporting a plurality of medicine bins. The cassette comprises a shelving structure including a rectangularly-shaped framing structure, a plurality of spanning bars connected to the frame and a plurality of angle bars connected to the spanning bars in an overlapping relationship. A pair of side support bars are connected to upstanding support bars connected to the framing bar and are provided to support the cassette in a pharmaceutical cart. A plurality of at least two such shelving structures may be readily formed into a single cassette. Advantageously, the structural bars, including the various support bars, may be made of a metallic material of substantially circular cross section. The wire cage cassette is provided with a bin locking bar attached to one of the upstanding support bars of the cassette structure for rotatably supporting the locking bar along a front side of the cassette for preventing removal of medicine bins from the cassette when the locking bar is maintained in the locking position. The side support bars are each provided with a flattened stop area for engagement with a stop member in the pharmaceutical cart when the cassette is in the cart to hinder unintentional removal of the cassette from the cart. A second flat stop area in each of the side bars allows the cassette to engage the stop member of the pharmaceutical cart when the cassette is partially removed from the cart. The cassette is provided with a security bar along the top front thereof to prevent removal of bins from the cassette by lifting a bin over the bin locking bar when the locking bar is retained in the locking position. The bin locking bar is supported by means of a support bracket comprising a vertically extending bar and two horizontally extending bars connected to one of the upstanding support bars of the cassette. A plate is connected to the vertical and horizontal sections for rotatably supporting the bin locking bar. A further plate section of the support bracket is formed perpendicularly to the plate member which is connected to the horizontal and vertical bars of the support bracket, and the further plate section serves as a stop member to prevent insertion of the cassette within a pharmaceutical cart beyond a predetermined distance. Advantageously, the plate which serves as a stop also improves aesthetics and covers a portion of the space between the sides of the cassette and the sides of the pharmaceutical cabinet. A top plane structure consisting of a rear support bar extending parallel to the security bar, a plurality of spanning bars extending between the rear support bar and the security bar, and a plurality of angled bars connected to the spanning bars in an overlaying relationship to provide additional support and a more aesthetically pleasing design.

In one specific embodiment of the invention, the side support bars and the security bar are formed integral with upstanding support bars for ease of manufacture of the cassette.

In one specific embodiment of a dispensing bin for use in a wire cage cassette of the invention, the cassette bin is provided with a handle having vertical side walls and an arcuate section which terminates on a protuberance extending beyond the lower wall of the bin. A second protuberance is formed by means of a shim on the lower wall of the bin and a bin positioning groove is defined between the two protuberances. Advantageously, this arrangement provides a firm engagement between the bins and the cassette shelving structure, hindering unintentional removal of the bins from the cassette structure.

BRIEF DESCRIPTION OF THE DRAWING

The invention is described with reference to the drawing, in which.

DETAILED DESCRIPTION

Figure 1:
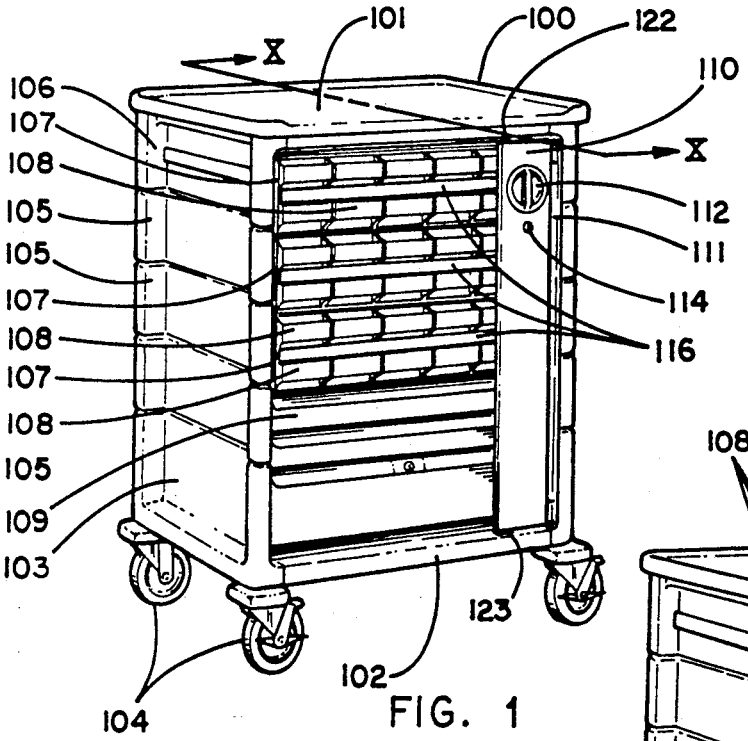
FIG. 1 is a perspective view of a pharmaceutical cart embodying the principles of the invention, shown in the locked condition.
Figure 2:
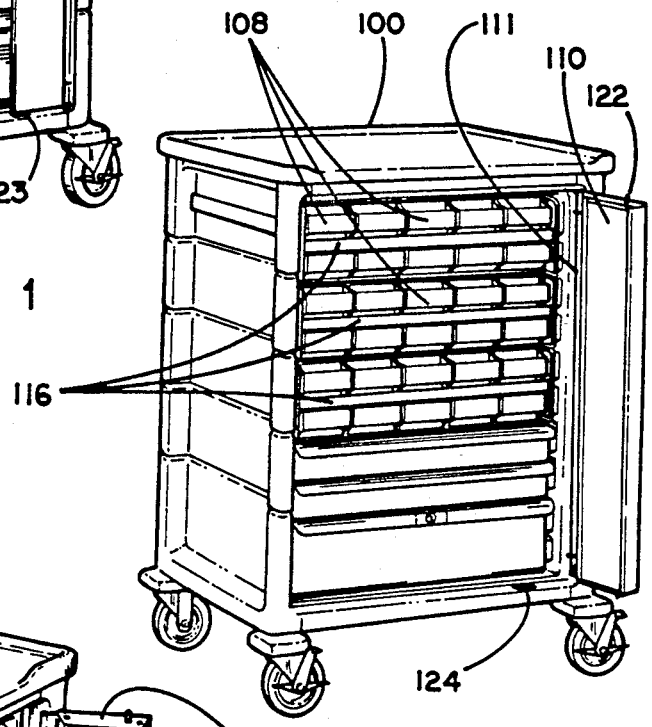
FIG. 2 is a perspective view of the pharmaceutical cart of FIG. 1, shown in the unlocked condition.

Referring to FIGS. 1 and 2, an illustrative embodiment of the invention comprises a segmented side wall pharmaceutical cabinet 100 having a housing comprising a top surface 101 and a base 102. The cabinet is provided with casters 104 and may be used as a pharmaceutical dispensing cart. The cabinet housing further comprises a base side wall segment 103, middle side wall segments 105 and a top segment 106. It is provided with a plurality of drawers 109 for containing various items and a plurality of pharmaceutical cassettes 107, each containing a plurality of bins 108. Each of the cassettes 107 comprises two rows of bins 108 disposed in a side-by-side relation, and is slidably removable from cabinet 100. Each of the cassettes 107 is further provided with a horizontally extending bin locking bar 116 extending frontally along a lower portion of an upper row of bins and a upper portion of a lower row of bins. The bin locking bar has an elongated cross section and is rotatable between a horizontal releasing position allowing for removal of individual ones of the bins 108 and a vertical locking position in which removal of the bins is restrained. A vertically extending cabinet locking bar 110 is hingedly attached to one side of cabinet 100 by means of hinge 111 and is rotatable between a locked position as shown in FIG. 1 and an unlocked position as shown in FIG. 2. When in the locked position, as shown in FIG. 1, cabinet locking bar 110 cooperates with the horizontally extending bin locking bars 116 of the individual cassettes 107, to lock each of the individual bins 108 in the cart. When in the locked position, the cabinet locking bar 110 engages each of bin locking bars 116 to prevent their rotation to a releasing position. The vertical locking bar 110 is provided with an upper locking pin 122 extending from a top edge of locking bar 110 and engaging an upper part of cabinet 100 and a lower locking pin 123 extending from a bottom edge of bar 110 and engaging a lower part of cabinet 100. A rotatable handle 112 is provided to operate locking pins 122, 123 to the unlocked position for opening vertical bar 110. A key lock 114 prevents rotation of the handle 112 unless operated by a key.

Figure 3:
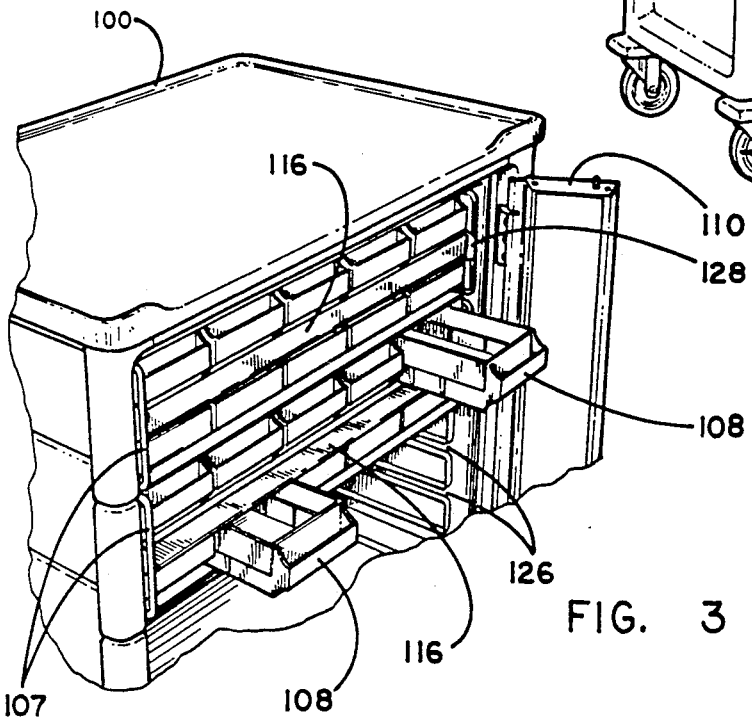
FIG. 3 is an enlarged fragmentary perspective view of the cart of FIGS. 1 and 2, showing greater detail.

FIG. 3 is an enlarged fragmented view of a top portion of cabinet 100 showing channels 126 for slidably engaging cassettes, such as cassettes 107. FIG. 3 shows two of the bins 108 of the lower of the two cassettes 107 in a partially withdrawn position. With cabinet locking bar 110 in the open position, as shown in FIG. 3, the bin locking bars 116 are allowed to rotate on pivot supports, such as pivot support 128. Withdrawal of any of the bins causes the corresponding bin locking bar to be rotated from a vertical orientation to a horizontal orientation, as reflected by the lower of the two bin locking bars 116 shown in FIG. 3. It will be readily apparent that none of the side-by-side bins can be removed when the corresponding bin locking bar is restrained from being rotated to the horizontal orientation by cabinet locking bar 110.

Figure 4:
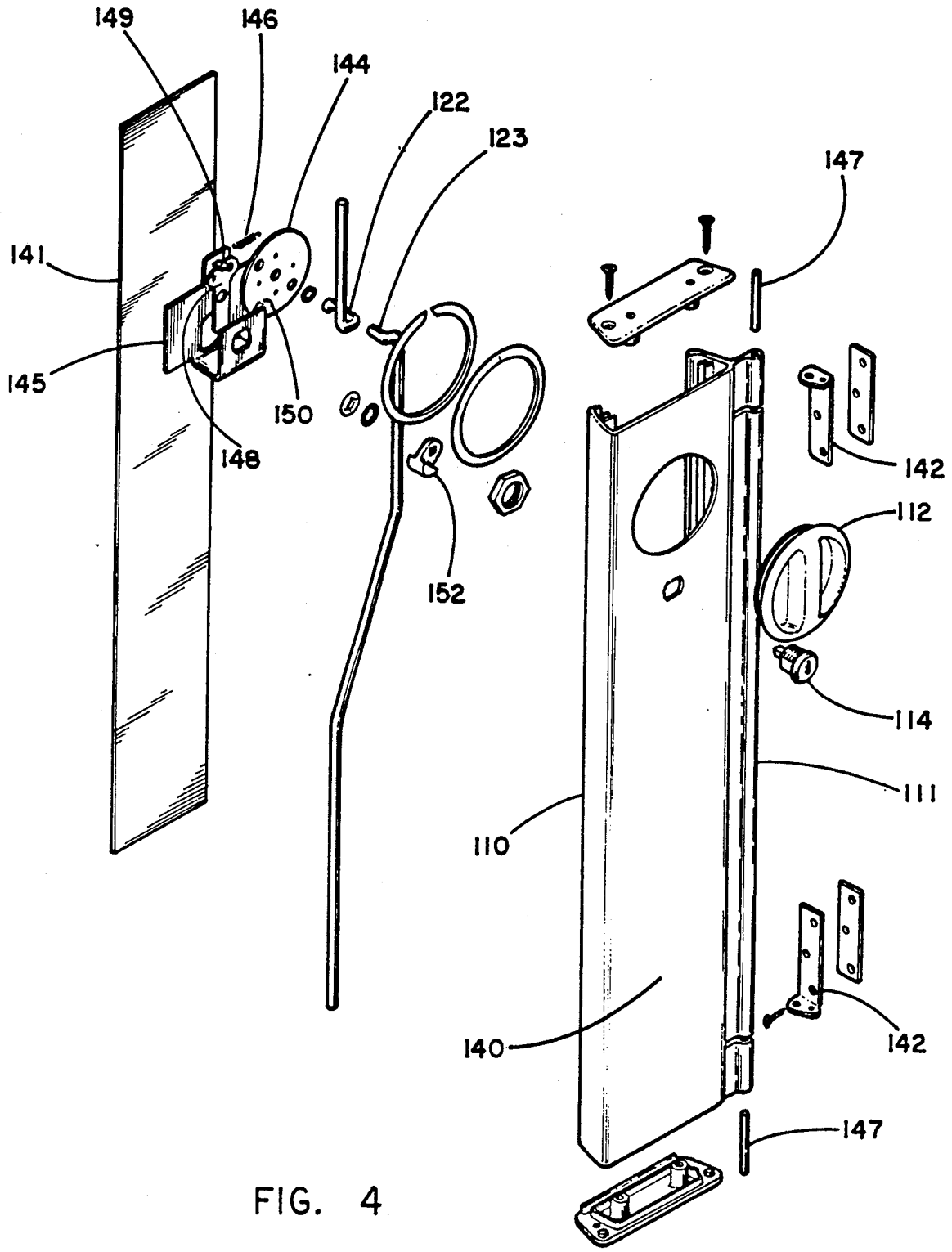
FIG. 4 is an exploded view of a key lock locking bar of the cart of FIG. 1.
Figure 5:
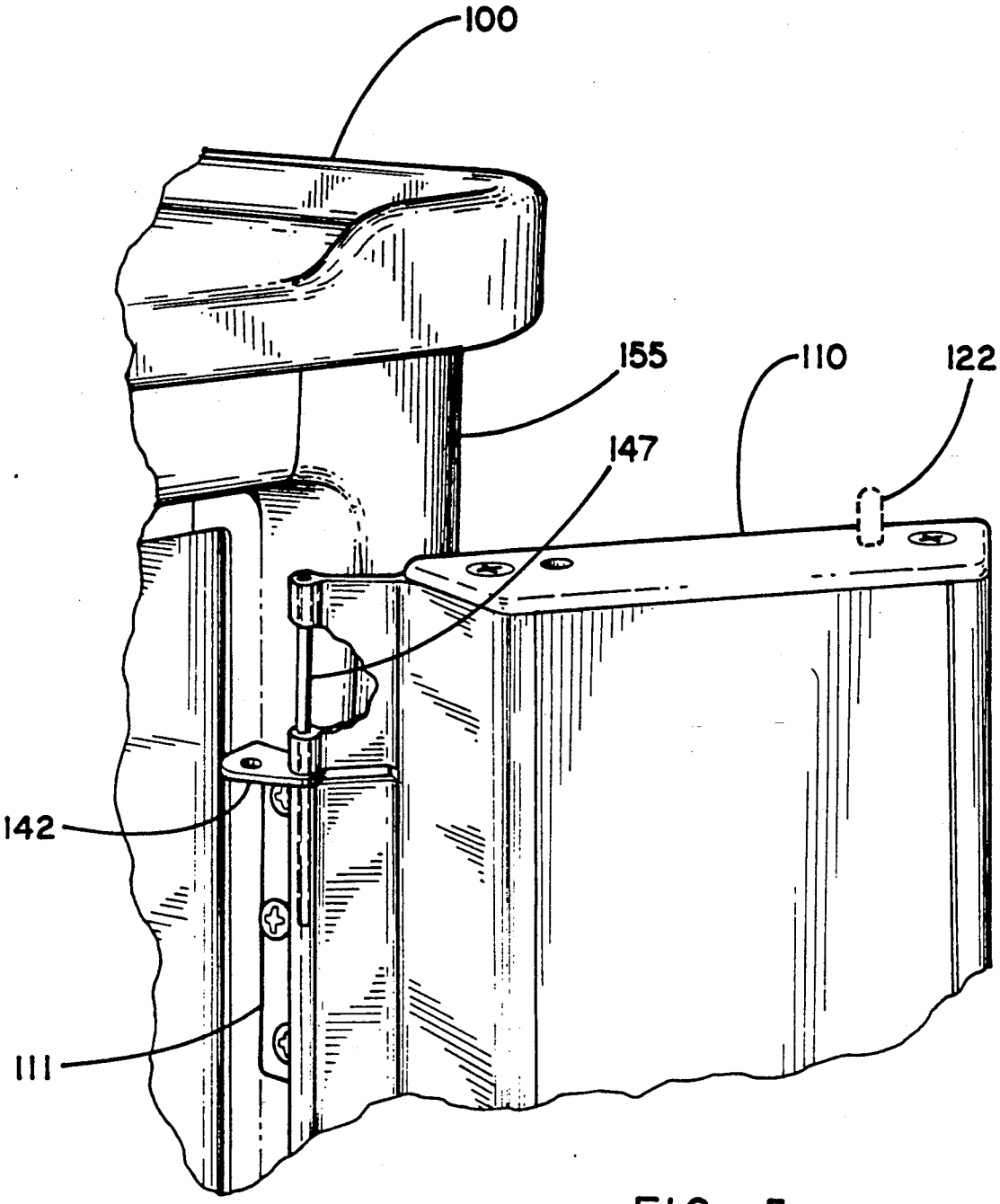
FIG. 5 is a more detailed view of the arrangement for attaching the key lock locking bar.

FIG. 4 is an exploded view of cabinet locking bar 110 showing details of the latching mechanism for engaging upper and lower portions of cabinet 100. The cabinet locking bar 110, which comprises a front panel 140 and a back panel 141 is attached to one side of cabinet 100 by means of brackets 142 engaging pins 147 of hinge 111. The latching mechanism of FIG. 4 includes upper and lower locking pins 122, 123 which engage a disk 144, which in turn engages rotatable handle 112. A latch arm 148 rotatably mounted on latch bracket 145, and provided with a latch tab 149, is urged against disk 144 by means of spring 146. The latching mechanism is shown in FIG. 4 in the unlocked position. Rotation of disk 144 in the clockwise direction, by means of handle 112, causes upper and lower locking pins 122, 123 to be extended for engagement with cabinet 100. As disk 144 is rotated in the clockwise direction, tab 149, being urged against disk 144 by spring 146, will engage slot 150 in disk 144, thereby latching the mechanism in the locked position. A key lock 114 is provided with a lock cam 152 for engaging latch arm 148. As key lock 114 is turned in a clockwise direction, latch arm 148 is rotated to disengage latch tab 149 from slot 150 and handle 112 may then be rotated in the counterclockwise direction to disengage upper and lower locking pins 122, 123 from housing 100. If thereafter the key lock 114 is rotated in the counterclockwise direction, cam 152 will be disengaged from latch arm 148 and spring 146 will act to urge latch tab 149 against disk 144. Consequently, the vertically extending cabinet locking bar 110 may again be locked to the cabinet by rotation of handle 112 and without the need for a key to operate key lock 114. FIG. 5 is a partially broken-away view of locking bar 110 showing engagement of pin 147 with hinge section 111' of cabinet locking bar 110 and attachment of bracket 142 to a vertical side 155 of cart 100.

Figure 6:
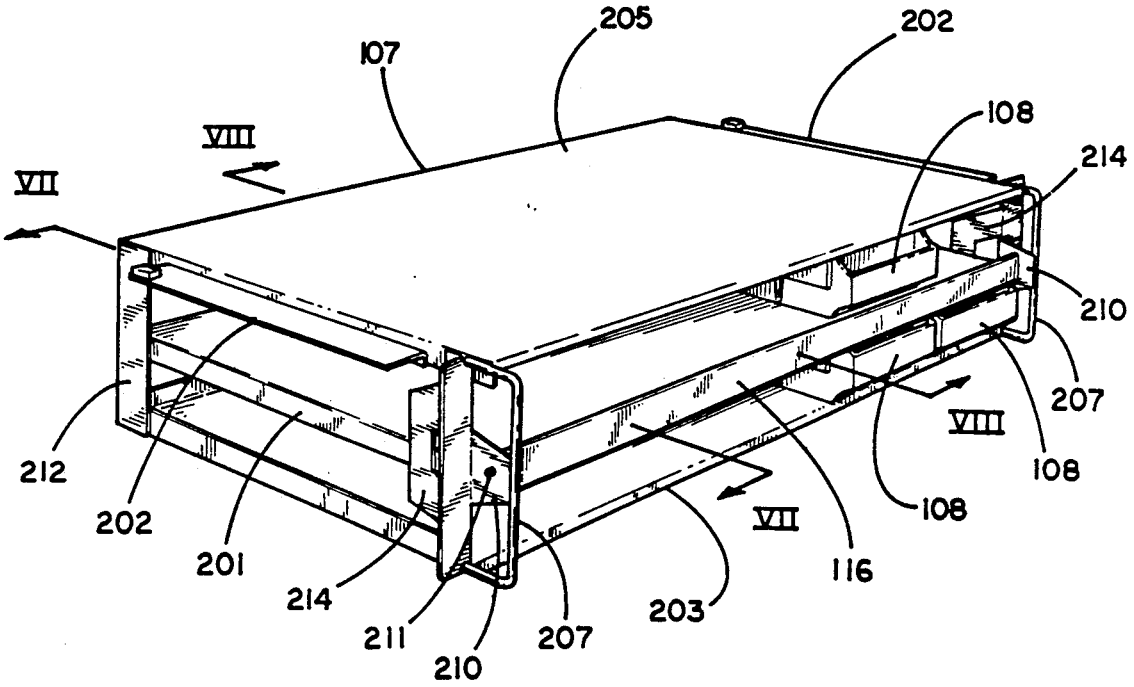
FIG. 6 is a perspective view of a partially occupied removable cassette of dispensing bins used in the cart of FIG. 1.
Figure 7:
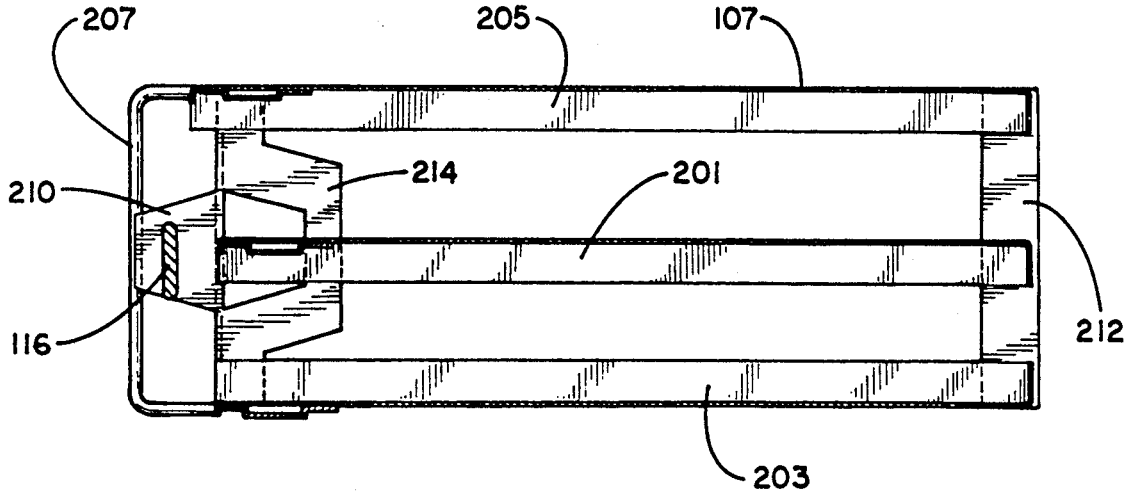
FIG. 7 is a cross-sectional view along line VII—VII of FIG. 6.
Figure 8:
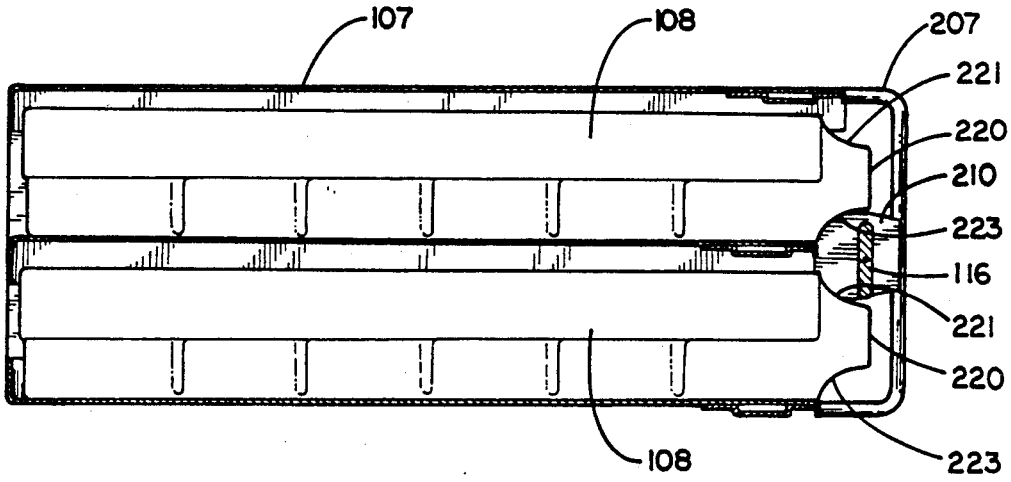
FIG. 8 is a cross-sectional view along line VIII—VIII of FIG. 6.
Figure 9:
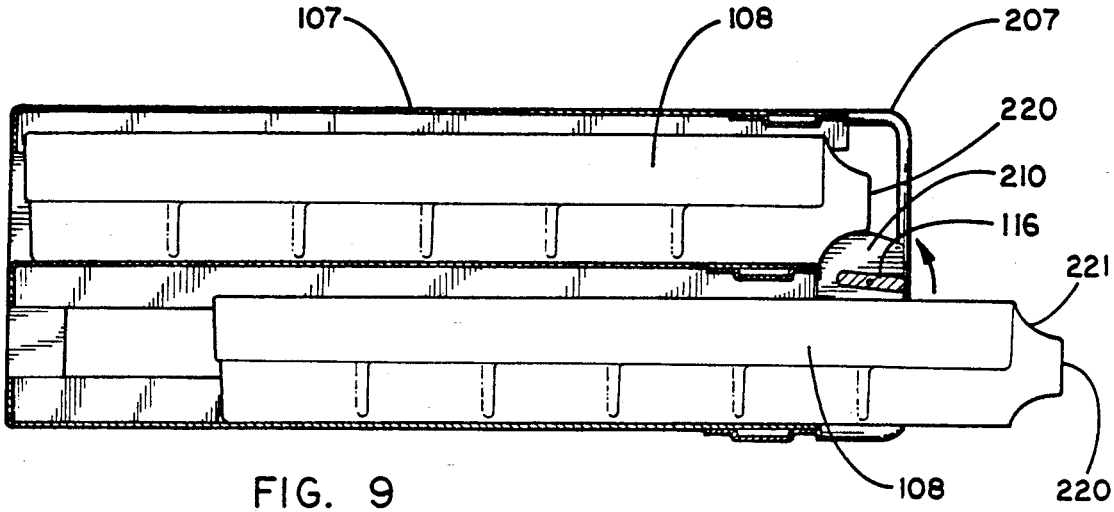
FIG. 9 is a modified cross-sectional view along line VIII—VIII of FIG. 6 showing a bin in a partially withdrawn position.
Figure 13:
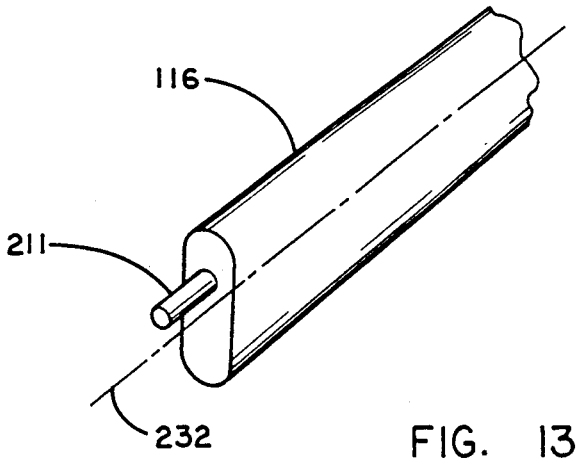
FIG. 13 is a partial perspective view of a bin locking bar used in the cart of FIG. 1.

FIG. 6 is a perspective view of one of the cassettes 107 of FIG. 1. The cassette comprises a pair of spaced-apart parallel shelves 201, 203 for supporting bins 108, and a top surface 205. Shelves 201, 203 and top surface 205 are spaced apart by a sufficient distance to accommodate bins 108 while preventing external access to the top opening of the bins. Shelves 201, 203 and top 205 are supported by means of back corner brackets 212 and front brackets 214. Handles 207 are provided for ease of insertion and removal of the cassettes in the cabinet housing of cart 100. Side rails 202 are provided for engagement with channels 126 (FIG. 3) of cabinet 100. Front brackets 214 are provided with tabs 210 for pivotally supporting bin locking bar 116 which engages tab 210 by means of pivot pin 211. FIG. 7 is a cross section along line VII—VII of FIG. 6 showing an unoccupied portion of cassette 107 and showing bin locking bar 116 in cross section. FIG. 8 is a cross sectional view of the cassette 107 along line VIII—VIII of FIG. 6 providing a view of the right-hand occupied portion of the cassette 107 of FIG. 6. Bin locking bar 116 is shown in cross section and showing its position relative to upper and lower bins 108 when the bins are contained within the cassette 107. The bins 108 are each provided with a front handle 220 having side panels provided with upper and lower arcuate sections 221 and 223, respectively. The arcuate sections are provided to accommodate the rotational movement of bin locking bar 116 while at the same time restricting forward travel of bins when bar 116 is locked in the vertical locking position. Even though the arcuate sections are not necessary for the upper edge of the upper one of the trays 108 or the lower edge of the lower one of the trays 108, the handles of all of the trays are made identical to facilitate interchangeability of the trays. The rotatable bin locking bar 116, shown in perspective view in FIG. 13, is provided with a pivot pin 211 which is offset from the geometric centerline 232 of bar 116 in order to provide a gravitational force urging bar 116 to the essentially vertical position as depicted in FIG. 8. The amount of offset is a matter of design choice and will be selected to obtain the desired effect of having bar 116 automatically return to the vertical position. This facilitates locking of the cabinet by movement of vertically extending cabinet locking bar 110 to its locking position. FIG. 9 is a cross-sectional view of the cassette 107 of FIG. 6 along line VIII—VIII except that one of the trays 108 is shown partially withdrawn from cassette 107. Bin locking bar 116 is shown in cross section in FIG. 9 and in a more nearly horizontal position to allow withdrawal of the lower one of the bins 108. The arrow in FIG. 9 indicates a rotation of bar 116 in the counterclockwise direction by engagement of arcuate section 221 of the lower bin 108, when the bin is withdrawn.

Figure 10:
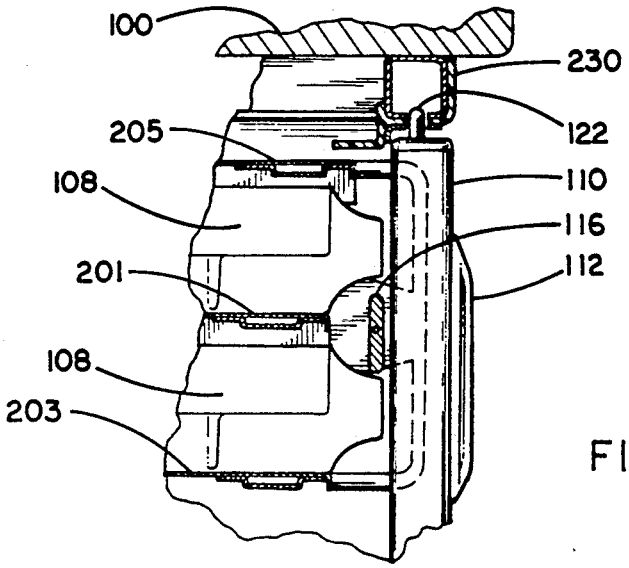
FIG. 10 is a cross-sectional view along line X—X of FIG. 1.

FIG. 10 is a partial sectional view of cabinet 110 along line X—X of FIG. 1. FIG. 10 shows the vertically extending cabinet locking bar 110 in its locking position with upper pin 122 engaging a structural member 230 of cabinet 100. Bin locking bar 116 is shown in cross section in the vertical or locking position. As will be apparent from the drawing, any attempt to remove one of the bins 108 from the cabinet housing 100, which requires rotation of bin locking bar 116 to the position indicated generally in FIG. 9, will be prevented by engagement of bin locking bar 116 with cabinet locking bar 110. Cabinet locking bar 110 similarly engages bin locking bars 116 of other cassettes 107 in cabinet 100, and in this manner cooperates with a plurality of bin locking bars 116 to prevent removal of any of the bins from any position within the cabinet. As is evident from the drawing, cabinet locking bar 110, when in its locking position, obstructs withdrawal of an entire cassette 107 as well as preventing withdrawal of the individual bins.

Figure 11:
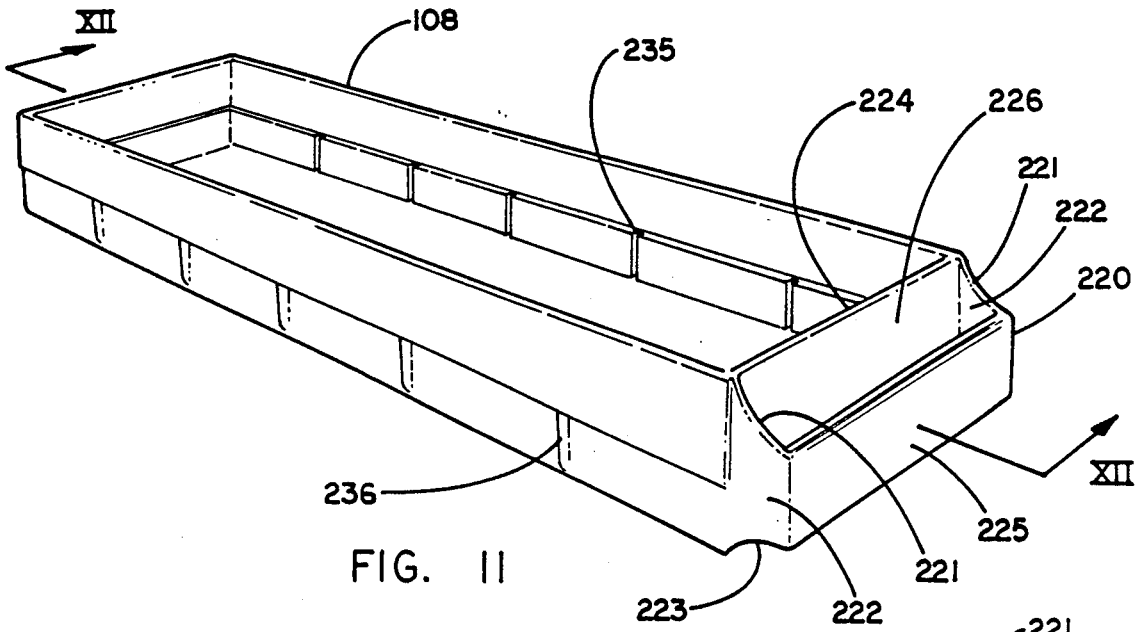
FIG. 11 is a perspective view of a bin for use in the cart of FIG. 1.
Figure 12:
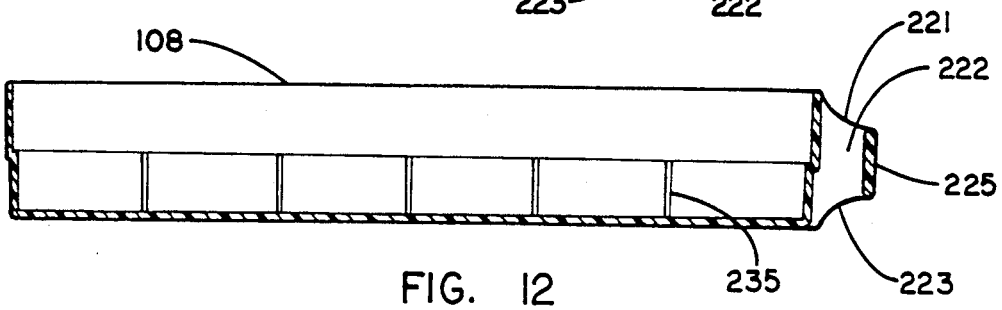
FIG. 12 is a cross-sectional view along line XII—XII of FIG. 11.

Referring to FIG. 11 and FIG. 12, which is a cross-sectional view along line XII—XII of FIG. 11, there is shown one of the bins 108 provided with a plurality of vertically extending slots 235 for receiving divider plates for providing a number of compartments within bin 108. External ribs 236 are provided at positions corresponding to slots 235. Handle 220 comprises frontal wall 225 and a pair of side walls 222 extending in a direction substantially perpendicular to frontal wall 225. A spatial area 226 is defined by the two side walls 222, handle frontal wall 225 and frontal wall 224 of bin 108. The spatial area conveniently allows for a handgrab of the handle 220 either from above or below frontal wall 225. Side walls 222 are each provided with top and bottom arcuate sections 221 and 223, respectively, as described earlier with respect to FIG. 8. Because the axes of rotation of bin locking bar 116 is offset from the geometric axis (FIG. 13), the space required for rotation of bar 116, as outlined by lower arcuate section 223 is smaller than the space required for rotation in the area of upper arcuate section 221. Accordingly, the arcuate sections may be dimensioned differently to accommodate rotation of bar 116.

Figure 14:
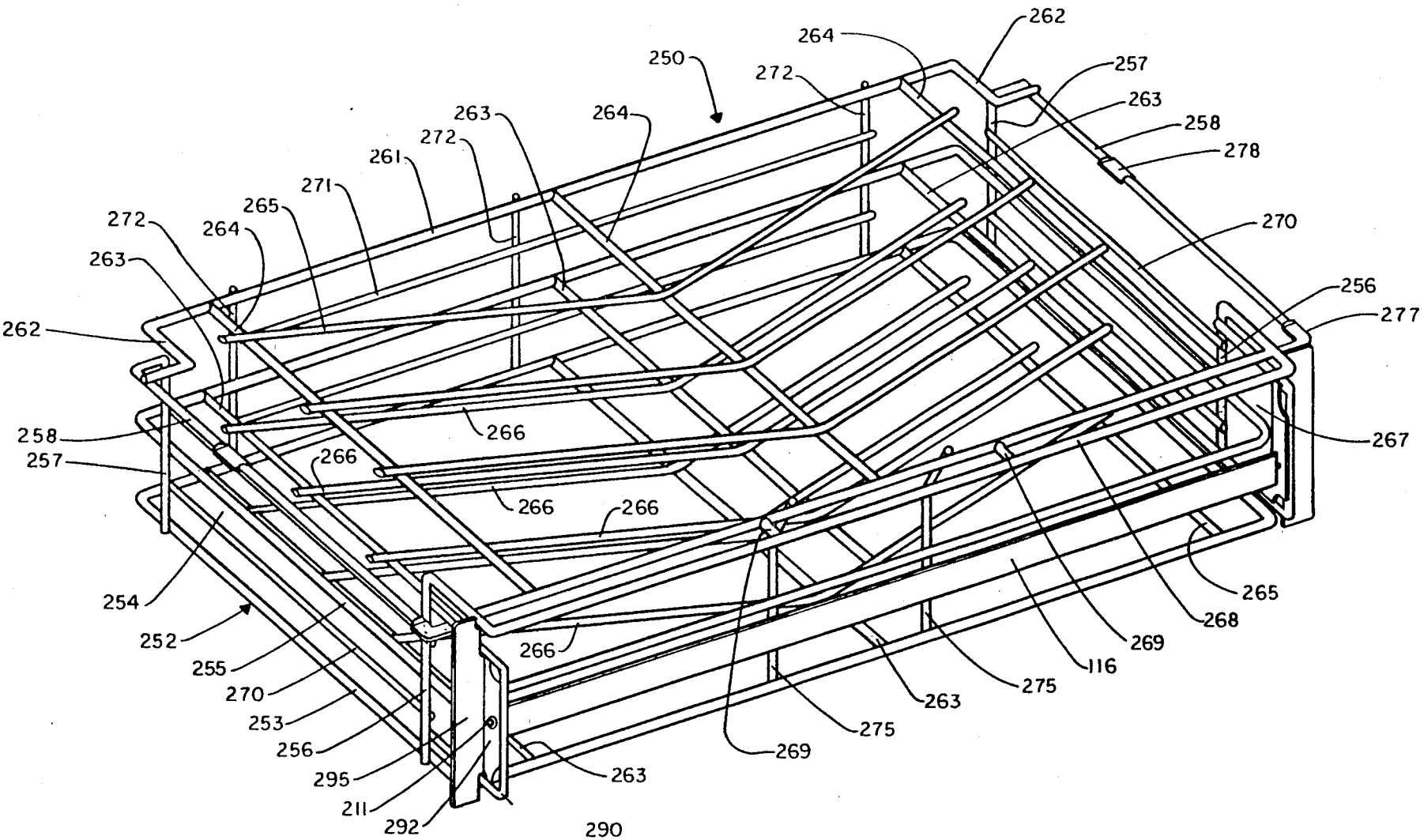
FIG. 14 is a perspective view of a wire cage cassette according to the invention for use in the pharmaceutical cart of FIG. 1.

FIGS. 14 through 17 show an alternate embodiment of the pharmaceutical cassette according to the invention. FIG. 14 is a perspective view of a cage cassette 250 comprising a plurality of metal interconnected bars structured to support medicine bins 108 in a medicine cabinet 100. The bars may be interconnected by resistance welding or arc welding in a well-known fashion. Referring to FIG. 14, a rectangularly-shaped bottom shelving structure 252 and upper shelving structure 254 are provided to support medicine bins 108. Each shelving structure 252, 254 comprises a framing bar 253, 255 extending along its perimeter, a set of three spanning bars 263 attached to framing bars 253, 255 at opposite sides of the shelving structure, and a set of three angled shelving bars 266 supported on and attached to the spanning bars 263 in an overlapping relationship. The shelving bars 266 are angled to facilitate insertion of medicine bins 108 and to enhance the aesthetic value of the cage cassette. Spatial separation is rigidly maintained between the shelving structures 252, 254 by a plurality of upstanding bar members, namely, a set of three rear support bars 272, a set of twin guide bars 275, and forward and rearward upstanding bar members 256, 257 located on both sides of the cage cassette 250. The primary purpose of the rear support bars 272 and the twin guide bars 275 is to increase the rigidity of the cage cassette which is desirable to prevent unauthorized removal of a medicine bin 108 by a bending of the structural members of the cage cassette 250. The middle one of the rear support bars 272 is offset from center to facilitate attachment of both the middle spanning bar 263 and the middle rear support bar 272 to the shelving structures 252, 254. The twin guide bars 275 in the front of the cage cassette 250 are spaced apart by a distance sufficient to receive a medicine bin 108, thereby assisting bin alignment.

Figure 17:
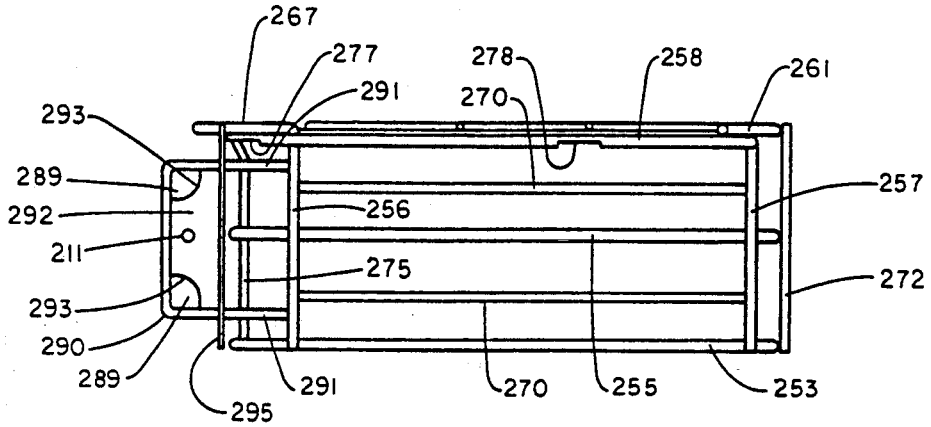
FIG. 17 is a side elevational view of the cassette of FIG. 14.
Figure 19:
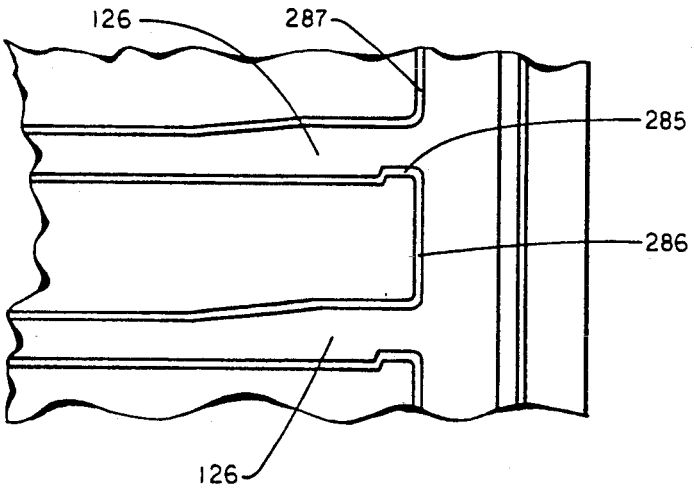
FIG. 19 is a partial fragmentary view of an interior wall of the pharmaceutical cabinet of FIG. 1 showing channels for supporting the cassette of FIG. 14.

A pair of cassette mounting or support side bars 258, formed integrally with the rearward upstanding bar members 257, are provided to support the cage cassette 250 in the channels 126 (FIG. 19) of the cabinet 100. Each cassette mounting side bar 258, while substantially circular in cross section, includes two flattened stops 277, 278. As shown in FIG. 17, the undersides of the flattened stops 277, 278 are markedly indented. FIG. 19 is a fragmentary view of an interior side wall of the cabinet 100 showing a series of support members 286, 287. These support members 286, 287 define channels 126 into which the side bars 258 of cage cassette 250 may be slidably inserted. A lip 285, located on the forward portion of the support member 286, acts against the indentation of the flattened stops 277,278 to impede motion of the cage cassette 250 relative to the cabinet 100. The forward flattened stop 277 engages the lip 285 during normal operation of the invention to prevent unintentional movement of the cage cassette 250 such as during removal of the bins 108. The rearward flatten stop 278 engages the lip 285 when the cage cassette 250 is partially inserted in the cabinet 100. When an operator withdraws the cage cassette 250 from the cabinet 100, the rearward flattened stop 278 and the lip 285 cooperate to halt travel of the cage cassette 250 at a location where it can be safely maintained. The cassette 250 pivots forward at the rearward flattened stop 278, and the rearward section of the cassette mounting side bar 258 abuts the underside of the higher support member 287, thereby preventing the cage cassette 250 from pitching forward. The location of stop 278 is further favorable in that it induces an operator to properly carry the cage cassette 250. When the cassette is positioned for engagement of stop 278 with lip 285, an operator can grasp the cage cassette 250 by the cassette mounting side bars 258, lift slightly and fully extract the cage cassette 250.

Figure 15:
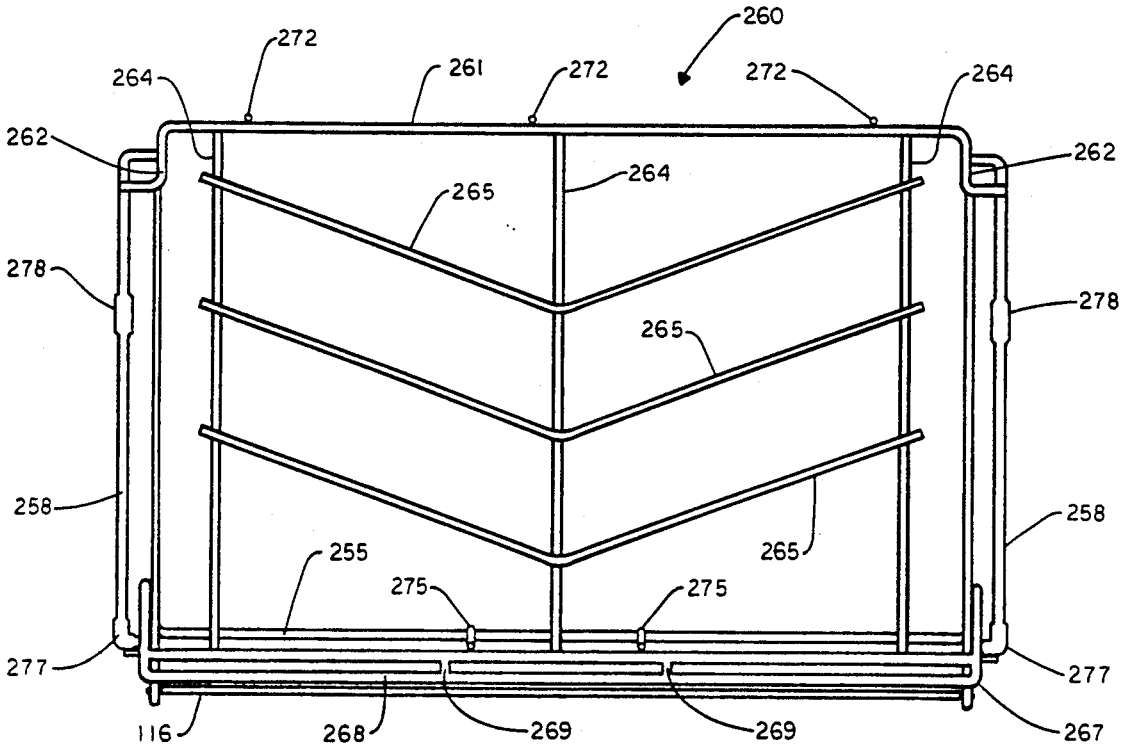
FIG. 15 is a plan view of the wire cage cassette of FIG. 14.
Figure 16:
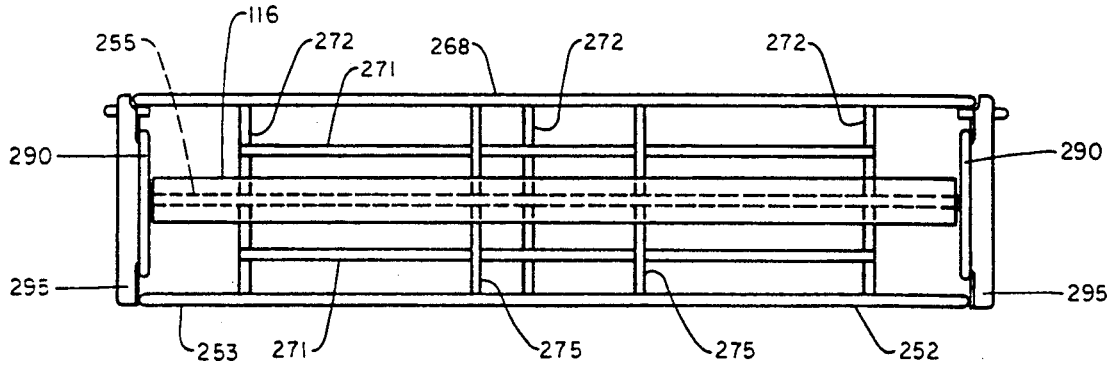
FIG. 16 is a front elevational view of the wire cage cassette of FIG. 14.

Referring to the plan view of FIG. 15, a top plane structure 260 comprises a rearward bar member 261 formed with two consecutive 90° bends 262 at each end, thereby allowing attachment to the cassette mounting side bars 258. An overhang security structure 267 forms the front of the top plane structure 260, and extends further forward than the shelving structures 252, 254. The primary purpose of the overhang security structure is to prevent a person from forcibly riding a bin 108 over the bin locking bar 116 when that bar is maintained in a locking position. The overhang security structure 267, which is integrally formed with the forward upstanding bar members 256, consists of twin bars 268 with increased rigidity due to their interconnection by spacers 269. Use of twin bars rather than a thicker bar decreases cassette weight without sacrificing security. A trio of spanning bars 264 and angled shelving bars 265 connect the rearward bar member 261 and the twin bars 268 primarily for aesthetic purposes.

FIG. 17 is a side elevational view of the cage cassette 250. As shown in FIG. 17, side bars 270 flank each shelving structure 252, 254. These side bars 270 serve as guides in the insertion of the medicine bin 108 into the cassette 250 and prevent the bins from catching on the rearward upstanding bar members 257. As shown more clearly in the frontal view of FIG. 16, rear bars 271 attach to the rear support bars 272 and prevent bins 108 from being inserted too deeply in the cage cassette 250. A pair of support brackets or front handles 290 are secured to the cage cassette 250 via extensions 291 attached to the forward upstanding bar members 256. Tabs 292, mounted on the handles 290, pivotably support the bin locking bar 116 through the action of a pivot pin 211. An open area 289, located between the handles 290 and arcuate tab sections 293, allows a cabinet operator to insert a finger and use the handles 290 to pull the cage cassette 250 forward from the cabinet 100. The open area 289 is made relatively small to discourage operators from using the handles 290 rather than the cassette mounting side bars 258 as a means for carrying the cage cassette 250. A plate 295, formed integrally with and perpendicular to the tabs 292, acts against the support members 286 (FIG. 19) of the cabinet walls to prevent a cage cassette 250 from recessing within the cabinet 100 while obscuring the channels 126 from view, thereby providing a more attractive appearance.

Figure 18:
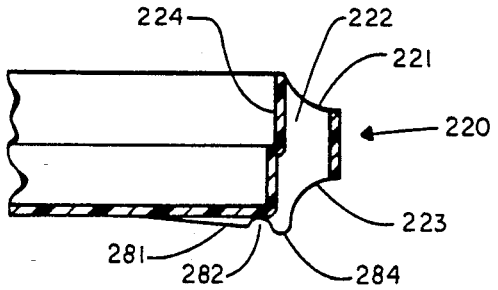
FIG. 18 is a partial sectional view of a bin for use in the cassette of FIG. 14.

FIG. 18 illustrates the structural adaptations of a medicine bin 108 for use with the cage cassette 250. As described earlier herein, bins 108 are each provided with a front handle 220 having side walls 222 provided with upper and lower arcuate sections 221 and 223, respectively. In the modified bin of FIG. 18, the lower arcuate section 223 of the side wall 222 terminates in a rounded protuberance 284 forward of the bin frontal wall 224. A biasing shim 281 on the underside of the bin near the frontal wall 224 tapers rearward and cooperates with the rounded protuberance 284 to define an arcuate positioning groove 282 which engages the forward side of the rectangularly-shaped framing bars 253, 255, thereby hindering movement of the bin 108 relative to the cage cassette 250. The overall height of the medicine bin 108, including the biasing shim 281, is such that the bin 108 can be placed on a shelving structure 252, 254 with sufficient clearance to allow for easy insertion but not sufficient clearance to remove the bin when the locking bar 116 is in the locking position.

While the invention has been described with particular reference to the vertically extending cabinet locking bar 110, it will be understood that other blocking members which extend vertically and frontally relative to the cassettes 107 and the bins 108 may be employed. Such blocking members can be disposed relative to the bin locking bars 116 to prevent the rotation of the bars between the locking and releasing positions. For example, the locking bar 110 can be in the form of a strap, bar, or other relatively rigid member which is secured to the top surface 101 and/or the base 102 of the cabinet 100, and which extends frontally relative to the cassettes 107 and the bins 108. Such a locking member is selectively positionable to either block rotation of the bin locking bars 116 or to allow rotation of the bars as may be desired.

It will be understood that the embodiments described herein are only illustrative of the invention and numerous other embodiments may be devised by those skilled in the art without departing from the spirit and scope of the invention.

What is claimed is:

1. A wire cage cassette for supporting a plurality of pharmaceutical dispensing bins in a pharmaceutical cabinet, comprising:

at least one rectangularly-shaped shelving structure having a perimeter and comprising a framing bar extending along said perimeter of said shelving structure in a predetermined plane and a plurality of spanning bars, including a central spanning bar and side spanning bars disposed on opposite sides of said central spanning bar, extending in said predetermined plane and attached to said framing bar at opposite sides of said rectangularly-shaped shelving structure and a plurality of angled shelving bars attached to said spanning bars in an overlapping relationship and each having substantially straight sections extending angularly with respect to sides of said shelving structure between said side spanning bars and said central spanning bar;

a pair of side support bars extending substantially parallel to opposite sides of said shelving structure and external to said framing bar for supporting said cassette in said pharmaceutical cabinet; and a plurality of upstanding support bars connected to said framing bar and extending in a substantially vertical direction from said framing bar, at least two of said upstanding support bars connected to each of said side support bars.

2. The cassette in accordance with claim 1 and further comprising another rectangularly-shaped shelving structure having a perimeter and extending in a plane substantially parallel said predetermined plane and comprising a framing bar extending along said perimeter of said another shelving structure and a plurality of other spanning bars attached to said framing bar of said another shelving structure at opposite sides of said another shelving structure and a plurality of other angled shelving bars attached to said other spanning bars in an overlapping relationship and extending angularly with respect to sides of said another shelving structure, said framing bar of said another shelving structure connected to said upstanding support bars at a position intermediate said side support bars and said at least one shelving structure.

3. The cassette in accordance with claim 2 wherein each of said side support bars is formed integral with at least one of said upstanding support bars.

4. The cassette in accordance with claim 2 wherein said angled shelving bars include a first straight section extending from one of said side spanning bars to said central spanning bar in a first direction and a second straight section extending from another of said side spanning bars to said central spanning bar in a second direction, said first and second straight sections forming an acute angle with said central spanning bar.

5. The cassette in accordance with claim 2 wherein each of said framing bars, said spanning bars, said angled shelving bars, said side support bars, and said upstanding support bars each comprise a metallic bar of substantially circular cross section.

6. A wire cage cassette for supporting a plurality of pharmaceutical dispensing bins in a pharmaceutical cabinet, comprising:

at least one rectangularly-shaped shelving structure having a perimeter and comprising a framing bar extending along the perimeter of said shelving structure and a plurality of spanning bars attached to said framing bar at opposite sides of said rectangularly-shaped shelving structure and a plurality of angled shelving bars attached to said spanning bars in an overlapping relationship and extending angularly with respect to sides of said shelving structure;

a pair of side support bars extending substantially parallel to opposite sides of said shelving structure and external to said framing bar for supporting said cassette in said pharmaceutical cabinet;

a plurality of upstanding support bars connected to said framing bar and extending in a substantially vertical direction from said framing bar, at least two of said upstanding support bars connected to each of said side support bars;

another rectangularly-shaped shelving structure extending in a plane substantially parallel said at least one shelving structure and comprising a framing bar extending along a perimeter of said another shelving structure and a plurality of other spanning bars attached to said framing bar of said another shelving structure at opposite sides of said another shelving structure and a plurality of other angled shelving bars attached to said other spanning bars in an overlapping relationship and extending angularly with respect to sides of said another shelving structure, said framing bar of said another shelving structure connected to said upstanding support bars at a position intermediate said side support bars and said at least one shelving structure; and a bin locking bar having an elongated cross-section and a pair of support brackets each attached to one of said upstanding support bars for rotatably supporting said locking bar along a front side of said cassette and frontally to said another shelving structure, said cassette locking bar rotatable about an axis of rotation substantially parallel to a front side of said another shelving structure to a releasing position wherein a longer dimension of said elongated cross section extends in a plane substantially parallel to said at least one shelving structure and rotatable about said axis to a locking position wherein said longer dimension extends in a direction substantially perpendicular to said at least one shelving structure.

7. The cassette in accordance with claim 6 and further comprising a horizontally extending security bar connected at each end to one of said upstanding support bars and extending along a front edge and above said second shelving structure and spaced apart from said second shelving structure by a vertical distance sufficient to allow free insertion and removal of pharmaceutical dispensing bins in said second shelving structure when said locking bar is in said releasing position and said vertical distance is such that removal of pharmaceutical dispensing bins from said second shelving structure is prevented when said locking bar is in said locking position.

8. The cassette in accordance with claim 7 wherein said security bar comprises a pair of interconnected substantially parallel bars.

9. The cassette in accordance with claim 7 wherein said upstanding bars connected to each end of said security bar are formed integral with said security bar.

10. The cassette in accordance with claim 7 and further comprising a top plane structure extending substantially horizontally to said upper and lower shelving structures, said top plane structure comprising said security bar and a rear support bar extending substantially parallel to said security bar and having opposite ends connected to said side support bars and a plurality of spanning bars connected to said security bar and said rear support bar and a plurality of angled bars connected to said spanning bars of said upper plane structure in overlapping relationship and extending angularly with respect to said spanning bars of said upper plane structure.

11. The cassette in accordance with claim 6 wherein each of said locking bar support brackets comprises a wire bar having a substantially vertically extending end section and a pair of horizontal wire bar members connected to one of said upstanding support bars and a plate member attached to said end section and said horizontal bars of said support bracket for rotatably supporting said locking bar, whereby said locking bar support bracket may be used as a handle for withdrawing said cassette from a pharmaceutical cart.

12. The cassette in accordance with claim 11 wherein said plate member of each of said support brackets comprises a first portion extending perpendicular to the axis of rotation of said locking bar and second section perpendicular to the first section and extending in a direction away from the locking bar, wherein said second section forms a stop member for prevention of insertion of said cassette in a pharmaceutical cart by more than a predetermined distance.

13. The cassette in accordance with claim 6 and further comprising at least one pharmaceutical dispensing bin adapted for insertion in said cassette, said bin comprising a bottom wall and a frontal wall and a handle connected to said frontal wall and having a pair of opposite side walls extending substantially vertically and perpendicularly to said frontal wall, said side walls having at least a lower arcuate cutaway section adjacent one end away from said frontal wall of said bin for allowing clearance for rotation of said locking bar when said dispensing bin is disposed in said upper shelving structure, said handle side walls terminating in a lower protuberance in an area adjacent said frontal wall, said bottom wall having a protuberance adjacent said protuberance of said handle side wall for defining a positioning groove on said bin for engagement with said framing bar of said upper shelving structure.

14. A wire cage cassette for supporting a plurality of pharmaceutical dispensing bins in a pharmaceutical cabinet, comprising:

at least one rectangularly-shaped shelving structure having a perimeter and comprising a framing bar extending along the perimeter of said shelving structure and a plurality of spanning bars attached to said framing bar at opposite sides of said rectangularly-shaped shelving structure and a plurality of angled shelving bars attached to said spanning bars in an overlapping relationship and extending angularly with respect to sides of said shelving structure;

a pair of side support bars extending substantially parallel to opposite sides of said shelving structure and external to said framing bar for supporting said cassette in said pharmaceutical cabinet;

a plurality of upstanding support bars connected to said framing bar and extending in a substantially vertical direction from said framing bar, at least two of said upstanding support bars connected to each of said side support bars; and another rectangularly-shaped shelving structure extending in a plane substantially parallel said at least one shelving structure and comprising a framing bar extending along a perimeter of said another shelving structure and a plurality of other spanning bars attached to said framing bar of said another shelving structure at opposite sides of said another shelving structure and a plurality of other angled shelving bars attached to said other spanning bars in an overlapping relationship and extending angularly with respect to sides of said another shelving structure, said framing bar of said another shelving structure connected to said upstanding support bars at a position intermediate said side support bars and said at least one shelving structure;

said side support bars each comprising a metallic bar of substantially circular cross-section and at least one flattened stop area in each of said side support bars adjacent a frontal end of said side support bars for engagement with a stop member in said pharmaceutical cabinet when said cassette is supported in said cabinet.

15. The cassette in accordance with claim 14 wherein each of said side support bars has a second flattened stop area for engagement with said stop member in said pharmaceutical cabinet when said cassette is partially removed rom said pharmaceutical cabinet.

* * * * *